US005827486A

United States Patent [19]

Crossdale

[11] Patent Number: 5,827,486

[45] Date of Patent: Oct. 27, 1998

[54] DISPENSER

[75] Inventor: Garry W. Crossdale, Alfreton, Great Britain

[73] Assignee: Diversey Lever, Inc., Plymouth, Mich.

[21] Appl. No.: 874,119

[22] Filed: Jun. 12, 1997

[51] Int. Cl.[6] ..... B01D 11/02

[52] U.S. Cl. ..... 422/282; 222/55; 222/64; 222/72; 222/71; 222/432; 222/433; 222/630; 422/263; 422/264

[58] Field of Search ..... 422/263, 264, 422/274, 275, 276, 277, 278, 282; 222/55, 64, 71, 72, 630, 432, 433

[56] References Cited

U.S. PATENT DOCUMENTS

| | | | |
|---|---|---|---|
| 2,738,323 | 3/1956 | Tepas, Jr. . | |
| 5,086,950 | 2/1992 | Crossdale et al. . | |
| 5,268,153 | 12/1993 | Muller | 422/282 |
| 5,342,587 | 8/1994 | Laughlin et al. | 422/282 |
| 5,456,297 | 10/1995 | Crossdale et al. . | |
| 5,549,875 | 8/1996 | Laughlin et al. | 422/282 |
| 5,597,021 | 1/1997 | Crossdale et al. . | |
| 5,682,930 | 11/1997 | Crossdale et al. . | |
| 5,743,311 | 4/1998 | Crossdale et al. . | |

FOREIGN PATENT DOCUMENTS

| | | |
|---|---|---|
| 300 819 | 1/1989 | European Pat. Off. . |

*Primary Examiner*—Timothy McMahon
*Attorney, Agent, or Firm*—A. Kate Huffman

[57] ABSTRACT

A dispenser system is provided, comprising a dispenser head (3), a feeding jet for water (7) at the dispenser head, and a reservoir immediately above the dispenser head for material to be dispensed, wherein an external supply of water is fed to a tank (4) arranged at a predetermined head above the dispenser head (3), wherein a feeding line (9) connects the tank (4) to the feeding jet (7), and wherein variations of flow to the tank (4) are accommodated by means of an overflow line (10) from the tank to a flushing jet (10) at the dispenser head, such that the water at the feeding jet (7) is always at a known pressure. This dispenser system was found to be a flexible arrangement in which low water pressures and/or varying water pressures can be adequately accomodated.

8 Claims, 2 Drawing Sheets

DISPENSER

FIELD OF THE INVENTION

The present invention concerns a dispenser, in particular a dispenser for dispensing cleaning substances, such as detergents, which are in solid form. For example, the cleaning substance might be in the form of a powder, pellets, briquettes or a block.

BACKGROUND OF THE INVENTION

In dispensers for detergents in solid form, it is conventional for a jet of water to be used to "wash" the detergent out of a reservoir so that the dissolved and/or diluted detergent can be fed to a dishwashing machine, for example. The jet of water may spray upwardly, into the reservoir, or can spray horizontally and then be deflected upwardly. In EP-A-300,819 (Diversey Corporation), such a horizontal spray is used and the deflector is fitted in the cap of a container of detergent which container is fitted, in an inverted manner, at the dispenser head. When emptied, the container is removed and a fresh container is placed in the dispenser.

Although many dispensers for detergents do work well, certain disadvantages can arise due to the fact that different geographical areas are subject to different water pressures and, furthermore, that the water pressure may be variable. Jet nozzles that may accommodate low pressures may suffer an impaired performance if the pressure varies. On the other hand, nozzles which can accommodate varying water pressures, possibly through the use of constant flow valves, typically require a relatively high mains pressure to work successfully.

There is thus a need for a more flexible dispensing arrangement in which low water pressures and/or varying water pressures can be accommodated.

DEFINITION OF THE INVENTION

Accordingly, the invention provides a dispenser system, comprising a dispenser head, a feeding jet for water at the dispenser head, a reservoir immediately above the dispenser head for material to be dispensed, wherein an external supply of water is fed to a tank arranged at a predetermined head above the dispenser head, wherein a feeding line connects the tank to the feeding jet, and wherein variations of flow to the tank are accommodated by means of an overflow line from the tank to a flushing jet at the dispenser head, such that the water at the feeding jet is always at a known pressure.

DETAILED DESCRIPTION OF THE INVENTION

Thus, the advantage of the invention is that whatever the mains pressure, the pressure of water at the feeding jet remains constant, because of the constant head of the tank. Furthermore, variations in mains pressure or flow to the tank are easily accommodated by the overflow line. The water passing down the overflow line to the flushing jet is itself used to advantage in the invention, since it helps to clear the dispensing head of any build-up of detergent.

Figure 1:
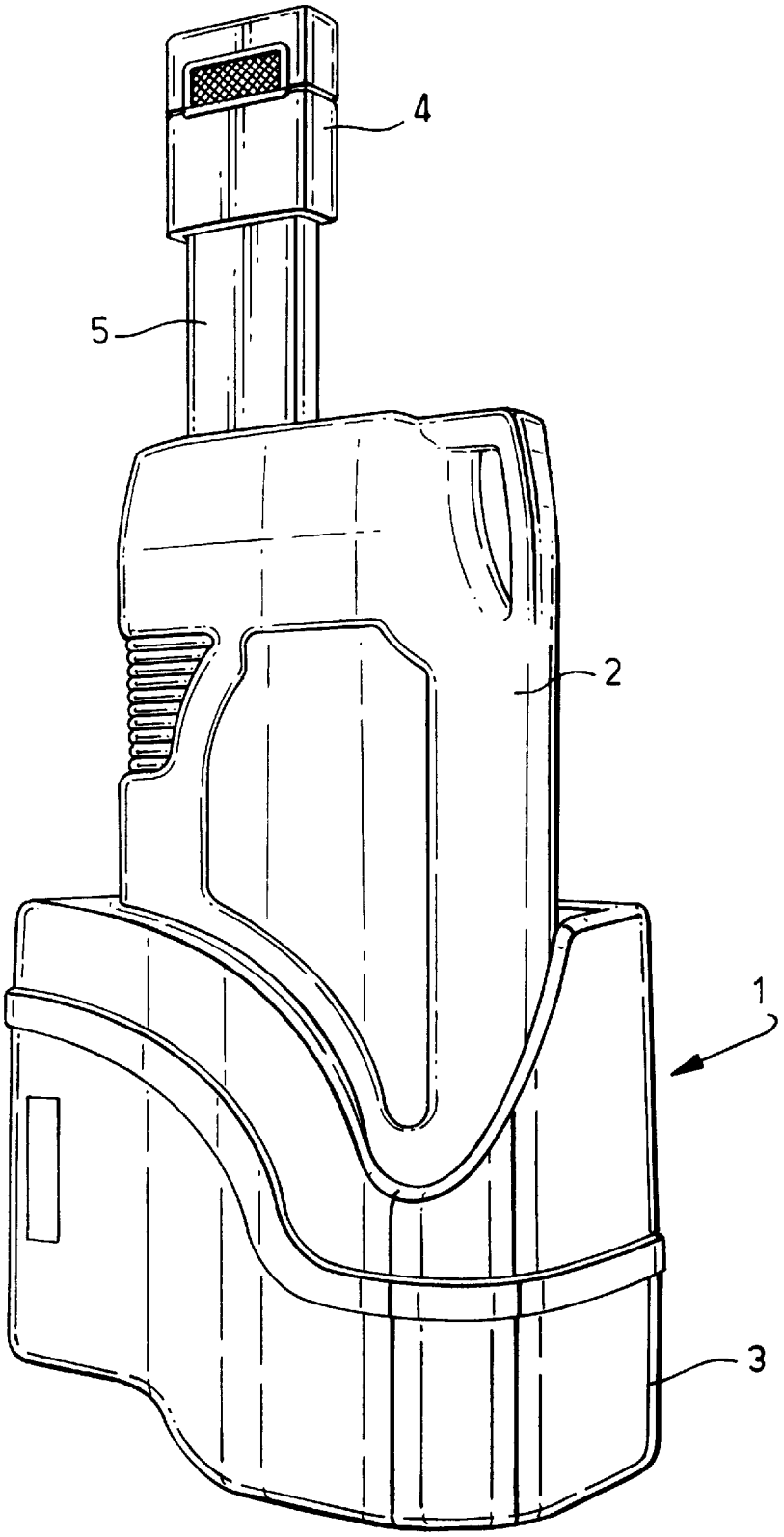
Figure 2:
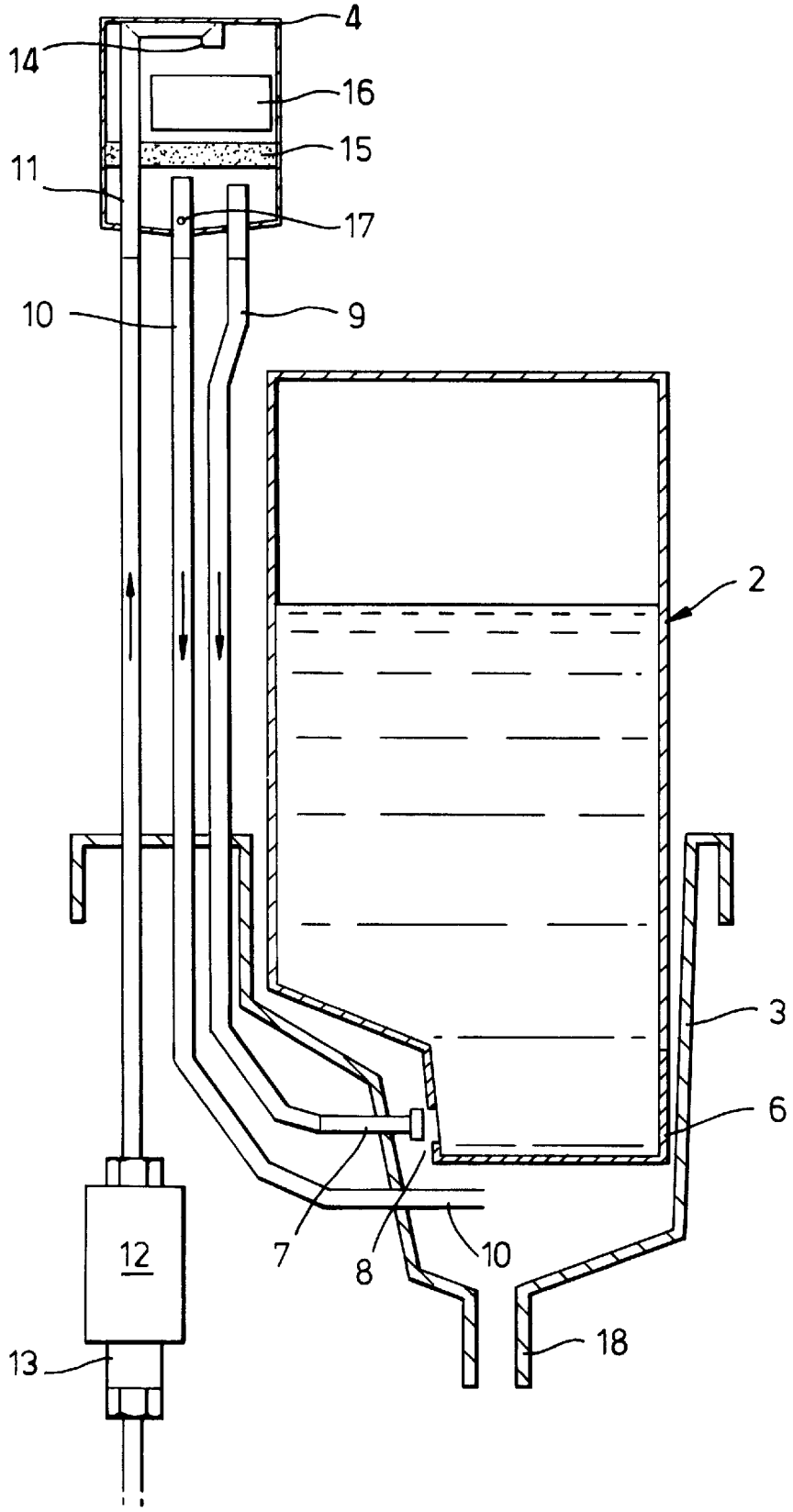

A preferred embodiment of the invention is described in more detail below, by reference to the accompanying drawings wherein:

FIG. 1 is a perspective view of a dispenser in accordance with the invention; and FIG. 2 is a schematic vertical sectional view of the dispenser.

FIG. 1 shows a pictorial view of a dispenser 1 which shares some similarities with that disclosed in EP-A-300,819. A container (2) of solid detergent material is placed in an inverted manner in a reservoir on a dispenser head (3). The internal features of the dispenser head and the way in which the detergent material is flushed are known from EP-A-300,819 and therefore the details are not repeated here.

FIG. 1 also illustrates, above the dispenser head, a tank (4) which is connected to the dispenser head by feed lines and flushing lines, housed behind cover (5).

The arrangement of the dispenser is more clearly seen in the schematic sectional view of FIG. 2. Container (2) is inverted on the dispenser head (3), with the dispensing cap (6) at the bottom. Feeding jet (7) feeds water substantially horizontally into the dispensing cap (6) through aperture (8). Above the dispenser is arranged the tank (4) and feeding line (9) connects the tank (4) to the feeding jet (7). There is also a line (10) connecting the tank to a flushing jet (10) arranged beneath the feeding jet (7).

Although in FIG. 2 a horizontal feeding jet is shown, it should be understood that the invention is not limited to horizontal jet.

The supply of water from the mains is fed to the tank by external supply line (11). The flow is controlled by a solenoid valve (12), to turn the supply on and off, and also the flow is controlled by simple constant flow valve (13) which is, however, optional. As seen in FIG. 2, the external water supply is discharged into the top of the tank through nozzle (14). The flow of water is broken up by a mesh or foam pad (15) fitted in the tank to avoid excess splashing. Alternatively a baffle plate could be used.

Also shown in FIG. 2 is an unrestricted overflow weir (16) to comply with water supply regulations regarding backsiphonage/backflow prevention.

The end of the flushing line (10) in tank (4) is arranged at a higher position than the end of the feeding line (9), the effect of this being explained below. In addition, an aperture (17) is provided at the bottom of the flushing line, inside the tank, to allow for a flow of water into the flushing line separate from the flow into the open top of the line.

The operation of the dispenser is as follows: a container (2) of the chemical to be dispensed is fitted in an inverted position in the dispenser head (3). The supply of water to the tank (4) is turned on by the solenoid valve (12). As water passes into the tank a small amount trickles through the hole (17) in the flushing line (10) to give a pre-flush of water at the dispenser head. As the water level in the tank rises, it reaches the open top of the feeding line (9) and thus water passes down the feeding line to the feeding jet to wash the product out of the container, to the outlet (18) which is connected, for example, to a dishwasher. As the level of water continues to rise, it reaches the top of the flushing line (10) to provide an additional flushing of the dispenser head. At this point, a steady state should be achieved, the diameters of the feeding line and flushing line having been previously calculated according to the incoming flow of water and the height of the tank above the dispenser head.

After dispensing of the chemical is no longer required, the supply of water is switched off by means of the solenoid valve. No more water is thus going into the tank and so the level falls below the top of the flushing line (10). The main flow of flushing water therefore stops. Next the water level reaches the top of the feeding line (9) and so the flow of water to the feeding jet stops and the washing of chemical out of the container ceases. However, due to the hole in the flushing line, a post-feed flush continues, in order to clean the dispensing head, until the tank is empty.

Typically, the flow of water to the tank might be about 3 litres per minute. The flow of water to the feeding jet might be approximately 1.4 litres per minute with the flush flow approximately 1.6 litres per minute.

The diameter of the feeding line might be 8 mm and that of the flushing line might be 6 mm, with the diameter of the pre- and post-flush hole in the flushing line being, say, 4 mm. The top of the feeding line might be 10 mm above the base of the tank with the top of the flushing line being 12 mm above the top of the feeding line. The characteristics of the feeding water jet can easily be controlled by varying the height of the tank and the diameter of the feeding tube. It has now been found that in typical installations, the height of the tank above the dispenser need only be in the order 0.45 m.

It should be noted that, instead of the hole in the flushing line, a third line could be fitted to provide the post- and pre-flush, this line opening at the bottom of the tank and being connected in the dispenser head near the flushing jet.

I claim:

1. A dispenser system, comprising a dispenser head (3), a feeding jet for water (7) at the dispenser head, and a reservoir immediately above the dispenser head for material to be dispensed, wherein an external supply of water is fed to a tank (4) arranged at a predetermined head above the dispenser head (3), wherein a feeding line (9) connects the tank (4) to the feeding jet (7), and wherein variations of flow to the tank (4) are accommodated by means of an overflow line (10) from the tank to a flushing jet (10) at the dispenser head, such that the water at the feeding jet (7) is always at a known pressure.

2. A dispenser system according to claim 1, wherein a container (2) of solid detergent material having a dispensing cap (6) is placed in an inverted manner in the reservoir.

3. A dispenser system according to claim 1, wherein the feeding jet (7) has a substantially horizontal direction.

4. A dispensing system according to claim 2, wherein the feeding jet feeds water into the dispensing cap (6) through an aperture (8), when in operation.

5. A dispensing system according to claim 1, wherein the external supply of water fed to tank (4) is controlled by solenoid (12).

6. A dispenser system according to claims 1, wherein the end of the overflow line (10) in tank (4) is arranged at a higher position than the end of the feeding line (9).

7. A dispenser system according to claim 1, wherein an aperture (17) is provided at the bottom of the overflow line (10), inside tank (4).

8. A dispenser system according to claim 1, wherein tank (4) is equipped with a mesh or foam pad (15) to avoid excess splashing.

* * * * *